United States Patent [19]

Herrington et al.

[11] 4,217,013

[45] Aug. 12, 1980

[54] CONTAINER SUPPORT

[75] Inventors: George B. Herrington, 216 Longmeadow Rd., Belvedere, S.C. 29841; Earl J. Allen, North Augusta, S.C.

[73] Assignee: George B. Herrington, Belvedere, S.C.

[21] Appl. No.: 2,311

[22] Filed: Jan. 10, 1979

[51] Int. Cl.[2] ..... A47B 88/00; A47F 5/12

[52] U.S. Cl. ..... 312/322; 312/323; 312/211; 248/133; 248/137

[58] Field of Search ..... 312/322, 323, 211, 245, 312/246; 211/80, 82; 248/137, 130, 133, 134, 207, 298, 311.1 R, 141, 95, 585

[56] References Cited

U.S. PATENT DOCUMENTS

| | | | |
|---|---|---|---|
| 375,158 | 12/1887 | Hill | 248/141 |
| 859,860 | 7/1907 | Weir | 312/323 |
| 1,356,085 | 10/1920 | Ottem | 248/207 |
| 2,233,796 | 3/1941 | Pines | 248/128 |
| 2,303,067 | 11/1942 | Richard | 248/134 |
| 2,372,544 | 3/1945 | Borman et al. | 248/137 |
| 2,548,204 | 4/1951 | Drake | 248/133 |
| 2,566,186 | 8/1951 | Gillett | 312/323 |
| 2,926,879 | 3/1960 | Dietrich | 248/311.1 R |
| 3,144,232 | 8/1964 | Smootz | 248/141 |
| 3,527,356 | 9/1970 | Herdy | 211/82 |

FOREIGN PATENT DOCUMENTS

| | | | |
|---|---|---|---|
| 915595 | 11/1972 | Canada | 312/211 R |
| 2402771 | 1/1974 | Fed. Rep. of Germany | 248/137 |

*Primary Examiner*—Victor N. Sakran
*Attorney, Agent, or Firm*—B. P. Fishburne, Jr.

[57] ABSTRACT

A support for a bulk liquid container includes a universal U-bracket mountable on a wall, floor or ceiling within a safety storage cabinet. Drawer type telescoping slides support a container basket structure pivotally suspended on the extensible and retractable sections of the slides which are horizontally arranged regardless of the disposition of the U-bracket. A bulk liquid container held by the basket structure can be rotated 360 degrees on the trunnions of the basket structure. A chain attachment is provided to support the container in a tilted liquid dispensing position. Due to its compactness and retractability, the support is useable in close quarters.

2 Claims, 7 Drawing Figures

FIG.1
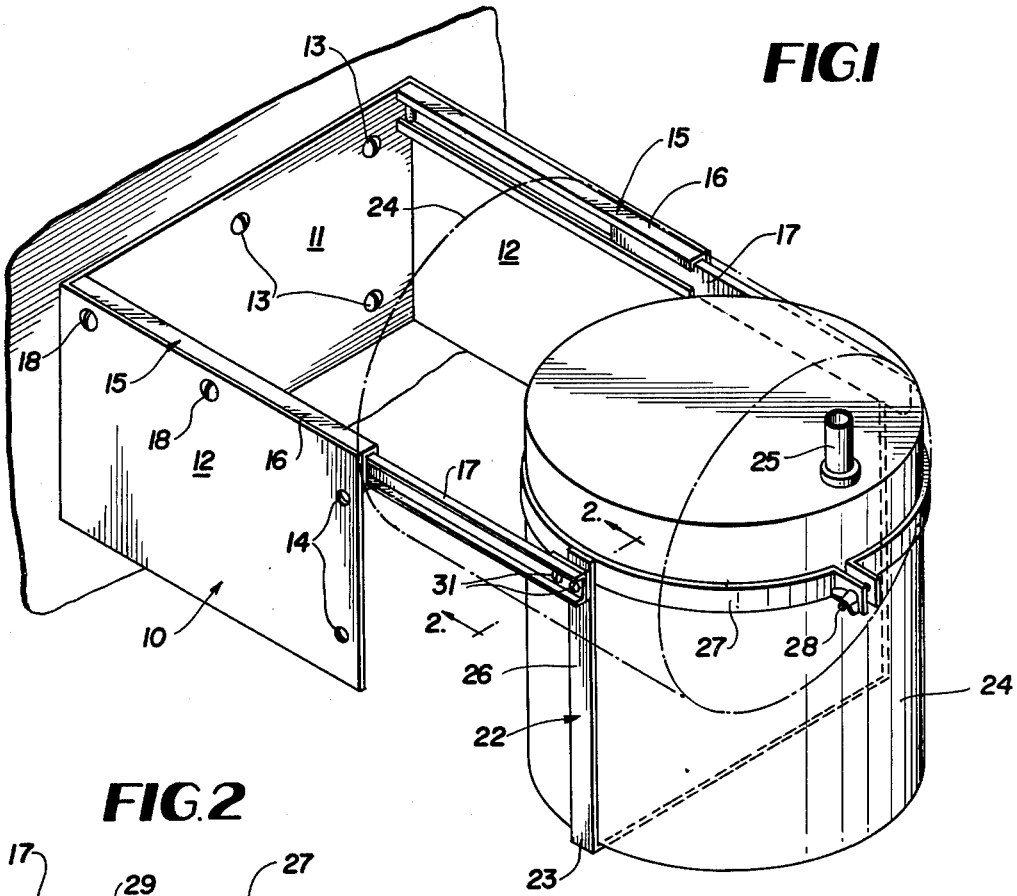
FIG.2
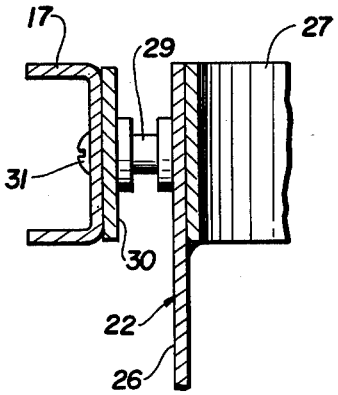
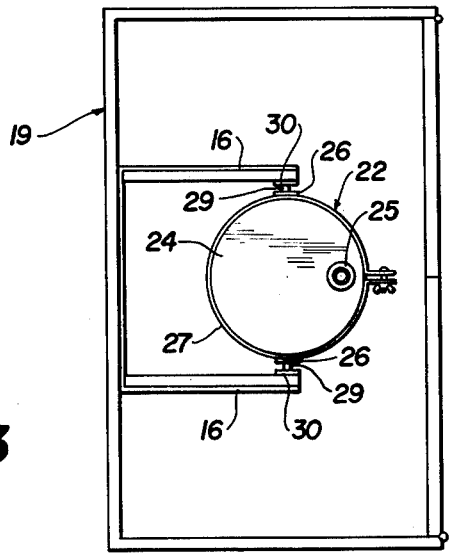
FIG.3

CONTAINER SUPPORT

BACKGROUND OF THE INVENTION

Tilting and extensible and retractable supports for containers in a broad sense are well known in the prior art. The known prior art support structures generally lack the ability to operate successfully in close quarters, as within safety cabinets or lockers for liquid chemicals. The prior art structures have tended to be excessively bulky and costly and to lack the capability of being mountable on either vertical or horizontal surfaces including overhead surfaces. The present invention possesses this capability fully by virtue of a simplified inexpensive and sturdy universally mountable U-bracket which in all use positions supports the extensible and retractable slides or tracks in the required horizontal positions. The overall compact structure of the invention permits it to be used effectively in very close quarters. In the overall, the support is characterized by simplicity and compactness, strength and durability, economy of manufacturing, and convenience of use.

Other features and advantages of the invention will appear to those skilled in the art in the course of the following detailed description.

BRIEF DESCRIPTION OF THE DRAWINGS

FIG. 1 is a perspective view of the invention in one use mode.

FIG. 2 is an enlarged fragmentary cross section through a trunnion taken on line 2—2 of FIG. 1.

FIG. 3 is a plan view of the invention according to FIG. 1 within a closed safety cabinet.

DETAILED DESCRIPTION

Figure 4:
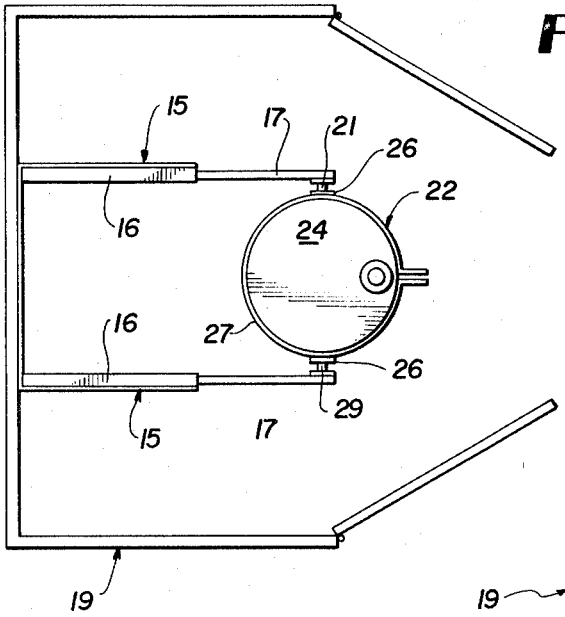
FIG. 4 is a similar view with the cabinet open and the support fully extended.

Referring to the drawings in detail wherein like numerals designate like parts, the numeral 10 designates a sturdy one-piece preferably steel mounting bracket of U-formation having a back or base plate 11 and parallel side plates 12 at right angles to the base plate 11. The base plate 11 has preferably five holes formed therethrough as illustrated to receive attaching screws 13 or the like. Each side plate 12 preferably has four openings 14 formed therethrough, one pair of such openings being along the ends of the side plates remote from the base plate 11, and the other pair of openings 14 being along one longitudinal edge of each side plate.

A pair of conventional extensible and retractable drawer slides or track assemblies 15 is embodied in the support, each comprising a relatively stationary channel section 16 and an extensible and retractable channel section 17 engaged telescopically inside of the larger section 16. The slides 15 may be of a commercial type manufactured and sold by KV Manufacturing, Grand Rapids, Mich., Model KV 1400 Drawer Slide, or equivalent device.

With the mounting bracket base plate 11 mounted vertically as in FIG. 1, the channel sections 16 are located on the inner faces of side plates 12 and along their top edges and are fixed to the side plates 12 by pairs of screws 18 passing through one pair of the openings 14 of each side plate.

Figure 7:
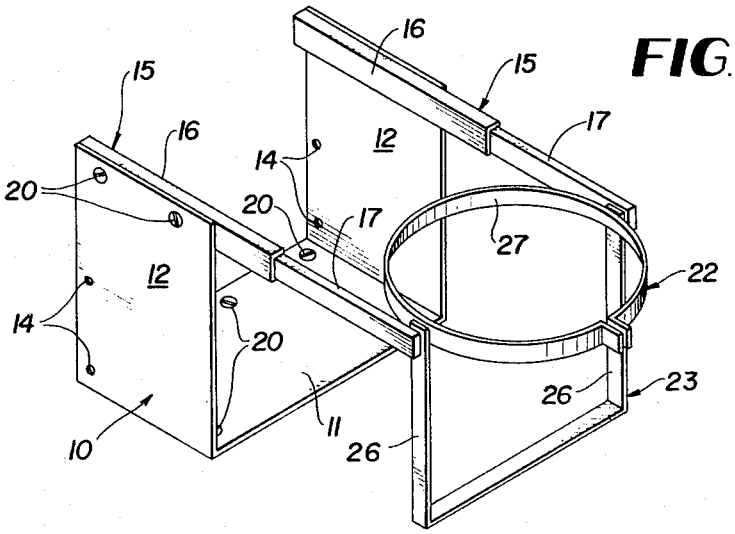
FIG. 7 is a perspective view of the support in a second use mode.

With reference to FIG. 7, the mounting U-bracket 10 is shown attached to a horizontal surface, such as the floor of a safety cabinet 19, by screws 20 engaging through the openings of base plate 11. In such use mode, the channel sections 16 of slides 15 are attached by screws 21 to the side plates 12 by utilization of the pair of openings 14 near the free ends of the side plates. This arrangement also prevails if the base plate 11 of the bracket 10 is attached to an overhead horizontal surface, such as the ceiling of safety cabinet 19 or locker. The overhead mounting is not shown in the drawings.

The universal mounting ability of the one-piece U-bracket 10 and the described arrangement of openings in the plates 11 and 12 of the bracket are important features of the invention. The conventional slides or track assemblies 15 contain stops, not shown, to limit forward extension of channel sections 17, safely.

The invention additionally comprises a container basket structure 22 consisting of a U-frame 23 for cradling a bulk liquid container 24, such as a can or carboy formed of metal or plastic and having a pouring outlet 25. The upright arms 26 of U-frame 23 are secured at their tops as by welding to the exterior of a split clamping ring 27 which embraces the upper end portion of the container 24 and is securely clamped about the container by an adjustable threaded fastener means 28, FIG. 1.

The basket structure 22 is equipped at the tops of the arms 26 with pivots or trunnions 29 of any preferred type and the trunnions are coaxial and are located at diametrically opposite points on the split clamping ring 27. The trunnions include at their outer ends fastening plates 30 which are fixedly attached by pairs of screws 31 to the extensible and retractable channels 17 of the two slides 15, each channel 17 having a pair of apertures located to receive the screws 31. The basket structure 22 and the container 24 mounted therein are rotatable as a unit a full 360 degrees on the axes of trunnions 29. FIG. 1 in phantom lines shows the carboy 24 in a rotated contents-pouring position substantially 90 degrees from the upright position shown in full lines. The carboy or container within the basket 22 will always gravitate to the upright position because of the location of the trunnions 29 well above the center of gravity of the container.

Figure 5:
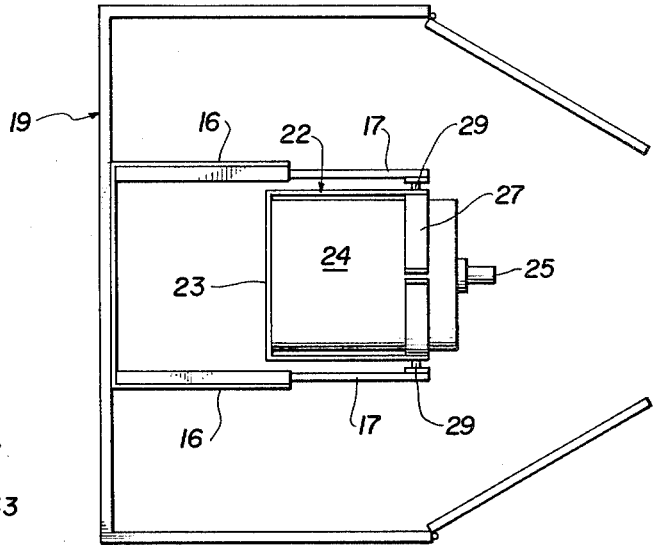
FIG. 5 is a further plan view of the invention with the container tilted to a dispensing position.
Figure 6:
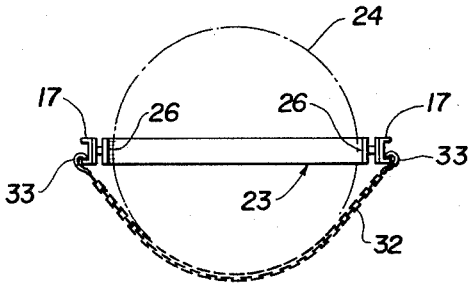
FIG. 6 is a schematic end elevational view of the support, parts omitted, showing the use of a chain attachment for retaining the liquid container in a dispensing position on the support.

As illustrated in FIG. 6, a simple chain attachment 32 having hooks 33 at each end can be utilized to support the container 24 in a pouring position, such as illustrated in FIGS. 1 and 5. The chain simply passes beneath the tilted container 24 with the hooks 33 engaged removably with the channels 17.

FIG. 3 shows the compactness of the support when it is fully retracted and the container 24 is in the normal upright position. In such condition, the support and container are easily housed inside of the safety locker 19. FIGS. 4 and 5 show the support fully extended with the cabinet or locker doors open so that the container and basket can be readily tilted for dispensing the liquid contents of the container, such as a caustic or toxic chemical. The support is not restricted in terms of its size, and typically, it can accommodate a five gallon carboy or the like. The use of the support as shown and described eliminates the need for lifting the heavy container and makes the handling of certain substances much more convenient and much safer, as should now be apparent to anyone skilled in the art.

It is to be understood that the form of the invention herewith shown and described is to be taken as a preferred example of the same, and that various changes in the shape, size and arrangement of parts may be resorted to, without departing from the spirit of the invention or scope of the subjoined claims.

We claim:

1. A support for a bulk liquid container or the like comprising a mounting bracket of U-formation having an apertured base plate for attachment selectively to a vertical surface or a horizontal surface, said bracket including a pair of parallel side plates projecting from the base plate substantially at right angles thereto, said side plates having apertures along their ends away from the base plate and having other apertures along correcponding longitudinal edges thereof, a pair of extensible and retractable telescoping bar slides adapted to be selectively attached to said side plates along said ends away from the base or along said corresponding longitudinal edges by the use of said apertures along said ends or along said longitudinal edges in conjunction with separable fasteners engaging said apertures, and a basket for holding a bulk liquid container having trunnions thereon near its top and on opposite sides thereof and said trunnions being attached to leading end portions of extensible and retractable bars of said slides, said basket having a U-frame adapted to engage under a container and an adjustable container clamping ring secured to the top of said U-frame in unitized relationship therewith.

2. A support for a bulk liquid container as defined in claim 9, and a flexible temporary support element having opposite end hooks releasably engageable with the extensible and retractable bars of said slides, the flexible support element being engageble under a tilted container to maintain it tilted during the pouring of liquid from the container.

* * * * *